United States Patent [19]

Van Besauw et al.

[11] 3,964,903

[45] June 22, 1976

[54] DEVELOPMENT OF ELECTROSTATIC IMAGES

[75] Inventors: Jan Frans Van Besauw, Brasschaat; Noël Jozef De Volder, Edegem; Jozef Leonard Van Engeland, St. Katelijne-Wayer; Albert Lucien Poot, Kontich, all of Belgium

[73] Assignee: AGFA-GEVAERT N.V., Mortsel, Belgium

[22] Filed: Feb. 21, 1974

[21] Appl. No.: 444,502

Related U.S. Application Data

[62] Division of Ser. No. 254,916, May 19, 1972, Pat. No. 3,817,868.

[30] Foreign Application Priority Data

May 21, 1971 United Kingdom ..... 16345/71

[52] U.S. Cl. ..... 96/1 SD; 252/62.1 P; 427/20; 427/21

[51] Int. Cl.[2] ..... G03G 5/10; G03G 13/08

[58] Field of Search ..... 96/1, 1.8; 252/62.1; 427/20, 21

[56] References Cited

UNITED STATES PATENTS

| | | | |
|---|---|---|---|
| 3,245,786 | 4/1966 | Cassiers | 96/1.8 |
| 3,681,243 | 8/1972 | Okuno et al. | 252/62.1 |

*Primary Examiner*—David Klein
*Assistant Examiner*—John L. Goodrow
*Attorney, Agent, or Firm*—William J. Daniel

[57] ABSTRACT

A developing material for use in the development of electrostatic images comprising toner particles and carrier particles is described wherein the developing material incorporates at least one solid hydrophobic bivalent or trivalent metal salt of a half-ester of a branched-chain or straight-chain aliphatic dicarboxylic acid and/or at least one bivalent or trivalent metal salt of a monoester or diester of a phosphorus oxyacid. The images obtained by means of this developing material have an improved image contrast, solid area coverage and surface smoothness. The toner particles show less tendency to cake and agglomerate and have improved mechanical strength. Cleaning of the imaging surface between use and re-use is also facilitated.

17 Claims, No Drawings

DEVELOPMENT OF ELECTROSTATIC IMAGES

This is a division of Ser. No. 254,916, filed May 19, 1972, now U.S. Pat. No. 3,817,868.

The present invention relates to electrophotography, and more particularly to improvements in the development of electrostatic images and to developers used therefor.

Known electrophotographic processes for producing visible images comprise the steps of electrostatically charging in the dark a photoconductive surface of an organic photoconductor e.g. zinc oxide and selenium or of an organic photoconductor, image-wise exposing the said surface to form a latent electrostatic image and developing the material to form a visible image by depositing on the image a finely divided electroscopic material usually a resin, which may be coloured and is known as "toner". Depending on the sign of the electrostatic charge the toner particles are attracted and deposited on the charged areas of the latent image or are repelled by the charged areas and deposited on the discharged areas. The toner image is then fixed by heating, by an overcoating treatment or by the action of solvents. Before fixing, the toner image may be transferred to a support surface such as paper and then permanently affixed thereto. Instead of forming the latent electrostatic image by the steps described above it is also possible to directly charge the photoconductive layer in image configuration.

For a better control of the development of the latent image the toner is used in combination with solid carrier particles or the toner particles can be dispersed in an insulating liquid.

If a dry developer is used, it is composed of two components, a finely ground pigmented or coloured resinous toner and a relatively coarse-grained carrier material. For the development of the latent image, the developing mixture may be cascaded merely over the exposed plate. The carrier material, e.g., glass or steel beads, which may be enveloped by a resinous film-forming product, carries the toner as it cascades over the plate and also triboelectrically charges the toner particles to the desired polarity. As the toner-carrier mixture flows over the latent electrostatic image bearing surface the toner particles are attracted by the charged areas of the image and not by the discharged areas or background areas of the image. Most of the toner particles accidentally deposited on the background areas of the image, are taken away by the rolling carrier particles due to the greater electrostatic attraction between the toner and the carrier than between the toner and the discharged background. The powder image formed is then fixed as described above on the photoconductive plate or can be transferred to a receptor surface, e.g. a paper sheet. The transfer can be accomplished by bringing the powder image in contact with the receptor surface, if necessary, in the presence of an electrostatic field. If the receptor surface, e.g. the paper sheet, is then stripped from the image-carrying surface, it carries with it a substantial amount of toner particles in the form of the desired image. Subsequently, this image can be made permanent, i.e. fixed, according to any desired method such as heating or solvent fixing.

Many of the known toner-carrier developing mixtures show certain disadvantages. For instance, some developer mixtures, though possessing desirable properties such as proper triboelectric characteristics are unsuitable because they tend to cake and agglomerate during handling and storage with the result that they are no longer free flowing and that a uniform distribution during development is no longer possible. In many toner-carrier mixtures the triboelectric and flow characteristics are adversely affected when the relative humidity is high. In other developing mixtures the toner particles tend to concentrate at the edge portions of the latent electrostatic image so that in reproducing large solid image areas the image is of proper density at the edges only, the image center being only partially developed. Moreover, some toners and carriers are abrasive in nature.

In accordance with the present invention, a toner material suitable for use in the development of electrostatic images is provided, which material comprises finely divided toner particles and incorporates at least one solid hydrophobic bivalent or trivalent metal salt of a half ester of a branched-chain or straight chain aliphatic dicarboxylic acid and/or at least one bivalent or trivalent metal salt of a monoester or diester of a phosphorus oxy-acid.

Such a toner material may incorporate carrier particles or it can be marketed without carrier particles. In the latter case, carrier particles can be added prior to use. Such carrier particles can be of conventional form and composition.

The invention also includes a developing material for use in the development of electrostatic images, which material comprises toner particles and carrier particles, and incorporates at least one solid hydrophobic bivalent or trivalent metal salt of a half-ester of a branched-chain or straight-chain aliphatic dicarboxylic acid and/or at least one bivalent or trivalent metal salt of a monoester or diester of a phosphorus oxyacid.

By means of a developer mixture according to the present invention electrophotographic images can be obtained, which have an improved image contrast and solid area coverage and which show an improved surface smoothness i.e., the image has no relieved image portions after fixing. Moreover, the toner particles show less tendency to cake and agglomerate and have improved mechanical strength. In addition thereto, by the presence of the said solid hydrophobic bivalent or trivalent metal salts in the developing material, cleaning carried out between use and re-use of the imaging surface is facilitated in that removal of residual toner particles from the imaging surface e.g. by means of a cleaning device or member such as a fibrous web is promoted.

The metal salts of use according to the present invention should be hydrophobic i.e. substantially insoluble in water. Otherwise, they would be adversely affected by the relative humidity of the atmosphere, in which the developing mixtures are used. For this purpose these metal salts should comprise a straight-chain or branched-chain aliphatic hydrocarbon group of at least 5 carbon atoms, preferably at least 10 carbon atoms, which group may be substituted with hydrophobic groups e.g. halogen, preferably fluorine and/or interrupted by hetero atoms e.g. oxygen, sulphur and nitrogen. This group may be an ester group of the said metal salts or a substituent on the chain linking the two carboxylic acid groups of the dicarboxylic acid. In the phosphorus oxyacids preferably all the hydrogen atoms, which are replaceable by a metal atom, are replaced by a metal atom.

Typical dicarboxylic acids, from which the hydrophobic metal salts may be derived, include: succinic acid, glutaric acid, maleic acid and glutaconic acid and mixtures thereof. The phosphorus oxyacids include ortho, pyro and hypophosphoric acid, phosphonic acids and phosphinic acids. Excellent results ae obtained where the metal of the metal salts is zinc. However, other salts may also be used for example magnesium salts, calcium salts, strontium salts, barium salts, iron salts, cobalt salts, nickel salts, copper salts, cadmium salts, aluminium salts and lead salts.

The preparation of the metal salts of the esters of phosphorus oxyacids as defined is quite simple. According to a paticularly suitable method a stoichiometric amount of oxyacid ester is dissolved in an aliphatic alcohol and added to a solution or suspension of a metal acetate in an aliphatic alcohol. The metal salt of the phosphorus oxyacid ester normally separates by precipitation in the alcohol or is obtained therefrom by evaporation of the solvent.

The following preparations illustrate how metal salts of phosphorus oxyacid esters were prepared.

PREPARATION 1

Copper(II) lauryl phosphonate 4 g of copper(II) acetate monohydrate were dissolved in 250 ml of methanol at 50°C. On adding to the warm solution, 5 g of lauryl phosphonic acid the copper(II) lauryl phosphonate precipitated. The precipitate was then washed with methanol of 50°C.

% of Cu calculated: 20.38

% of Cu found: 20.35

PREPARATION 2

Zinc mono(2-butyloctyl)phosphate a. mono(2-butyloctyl)phosphoric acid

A solution of 2 moles of 2-butyloctanol in 500 ml of dichloroethane was added dropwise with stirring to a solution of 2 moles of phosphorus oxychloride and 2.05 moles of pyridine in 500 ml of dichloroethane whilst maintaining the temperature at about 22°C. The pyridinium chloride formed was filtered with suction and the filtrate concentrated by evaporation. The residual oil was mixed with 1 liter of water and heated for 2 hours with stirring on a boiling water bath. The mixture was then extracted with benzene, whereupon the latter was evaporated under reduced pressure. The residue obtained was completely degassed by means of an oil pump.

Yield: 70%.

b. zinc mono(2-butyloctyl)phosphate

A solution of 1 mole of zinc acetate dihydrate in 750 ml of methanol at 55°C was added to a solution of 0.7 mole of mono(2-butyloctyl)phosphoric acid in 500 ml of methanol.

The zinc salt precipitated and after 30 min. the supernatant liquid was eliminated. The precipitate was heated thrice for 15 min. in 350 ml of methanol on a water-bath. Each time the methanol was decanted.

After the last decantation the residue was dissolved be refluxing in 1.7 liter of acetone. Upon cooling, the zinc salt crystallized from the solution.

Yield: 77%

PREPARATION 3

Zinc monoisohexadecyl phosphate a. In a 2 liter reaction vessel fitted with stirrer, thermometer and dropping funnel were placed 459 g (3 moles) of phosphorus oxychloride. The phosphorus oxychloride was cooled to 0°C and then 726 g (3 moles) of isohexadecyl alcohol (commercially available from Esso Belgium N.V., Antwerp) was added dropwise in such a way that the hydrogen chloride formed escaped gradually. As soon as all of the isohexadecylalcohol was added, the temperature had risen to about 25°C. The mixture was left standing overnight and then stirred for a few hours while nitrogen was introduced to remove residual hydrogen chloride.

Yield: 1055 g (98%).

b. In a 10 liter reaction vessel fitted with stirrer, thermometer and dropping funnel were placed: 2.8 liters of water, 300 ml of hydrochloric acid and 1260 ml of dioxan. The mixture was heated on a boiling water-bath to 80°C whereupon a solution of 1010 g of the product formed in step a in 1250 ml of dioxan was added dropwise over 90 minutes. The temperature rose to 92°C and the mixture was stirred for 5 hours at this temperature. The mixture was cooled and the oil separated and agitated with benzene. After concentration on a water-bath of 75°C, 890 g (98%) of isohexadecyl phosphate was formed.

c. 1 mole of isohexadecyl phosphate was dissolved in methanol whereupon a solution of 1 mole of zinc acetate -2-water in 750 ml of methanol was added. The precipitate formed was separated and then stirred several times with warm methanol. The product was heated on a water bath to remove all methanol and then recrystallized from ethylene glycol monomethyl ether.

The metal salts of the half-esters of aliphatic dicarboxylic acids can be prepared in a similar way. A stoichiometric amount of the half-ester is dissolved in acetone and the solution obtained is added to a solution of a metal acetate in an aliphatic alcohol. The metal salt of the half-ester separates by precipitation in the medium. The half-esters used can be prepared e.g. by refluxing the cyclic dicarboxylic anhydride and the alcohol in toluene and then evaporating the solvent.

The following preparation illustrates how the metal salts of the half-esters of the dicarboxylic acids were prepared.

PREPARATION 4

Zinc dodecyl succinate 0.05 mole of succinic anhydride and 0.05 mole of dodecyl alcohol were refluxed for 5 hours in 100 ml of toluene. The solution was concentrated by evaporation and the residue solidified at room temperature. The monolauryl succinic acid was recrystallized from 100 ml of hexane.

A solution of 0.02 mole of monolauryl succinic acid in 100 ml of acetone was mixed with a solution of 0.01 mole of zinc acetate in 20 ml of ethanol. The mixture was left standing overnight whereupon the precipitate formed was filtered by suction, washed with ethanol, acetone and ether, and dried in vacuum.

Melting point: 124°C.

In a similar way were prepared, zinc decyl succinate (m.p. 123°C), zinc undecyl succinate (m.p. 121°C), zinc tetradecyl succinate (m.p. 123°C), zinc hexadecyl succinate (m.p. 124°C), zinc octadecyl succinate (m.p. 123°C), zinc docosyl succinate (m.p. 123°C),

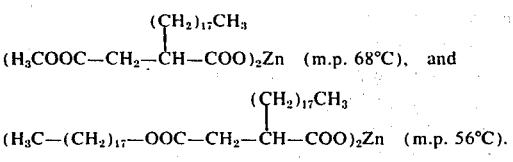

$$(H_3COOC-CH_2-\overset{(CH_2)_{17}CH_3}{\overset{|}{C}}H-COO)_2Zn \quad \text{(m.p. 68°C), and}$$

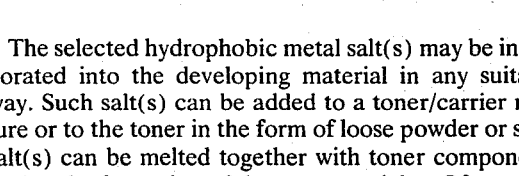

$$(H_3C-(CH_2)_{17}-OOC-CH_2-\overset{(CH_2)_{17}CH_3}{\overset{|}{C}}H-COO)_2Zn \quad \text{(m.p. 56°C).}$$

The selected hydrophobic metal salt(s) may be incorporated into the developing material in any suitable way. Such salt(s) can be added to a toner/carrier mixture or to the toner in the form of loose powder or such salt(s) can be melted together with toner components during the formation of the toner particles. Of course a quantity of one or more salts may be incorporated in the toner particles while another quantity of one or more said salt(s) is mixed with the toner or with the toner/carrier mixture.

Toner mixtures can be made, in which the metal salt(s) in powder form is or are ground against the surface of the toner particle or in which the metal salt(s) is or are dispersed throughout the toner particle. When the metal salt is applied as a loose powder, it is preferably used in the form of finely divided particles, having for instance an average size of about 1 micron to about 50 microns.

The hydrophobic metal salt(s) used according to the invention is or are preferably added to the toner particles or melted together with the components used in the production of the toner particles. However such salt(s) may be dispersed throughout the carrier particles or coated onto preformed carrier particles for example in the form of loose powder, a melt, or a solution or in association with a film-forming binder, which includes for instance phenol-formaldehyde resins, vinylidene chloride resins, butadiene polymers, vinyl chloride-vinyl acetate copolymers, melamine resins, cellulose nitrate, ethylcellulose, alkyd resins, etc.

The amount of metal salt present in the toner-carrier developing mixture may vary within very wide limits and depends on the manner, in which the metal salt is incorporated into the developing mixture. Generally the metal salts are used in amounts from about 0.1 to about 50%, preferably from about 0.5 to 20% based on the weight of toner. Obviously, with a given quantity of metal salt based on the weight of the toner or carrier, a greater volume of the salt is available at the surface of the toner or carrier when the metal salt is added to a mixture of preformed coloured toner particles or carriers than when it is intimately dispersed within each toner particle or carrier.

In the preparation of a toner-carrier developing mixture according to the present invention, the carrier and toner are preferably mixed in a ratio comprised between 100 to 0.1 and 100 to 20, preferably between 100 to 0.5 and 100 to 10.

It is suitable to use carriers having an average grain size between 100 and 1000 microns, although smaller or larger carrier particles may be used. The toner particles suitably have a particle size of less than 50 microns and preferably size between 1 and 30 microns.

Suitable coated and uncoated carrier materials are well known in the art. The carrier particles can be iron filings, glass balls, silicon dioxide particles, granular zircon, polymethyl methacrylate particles, crystals of inorganic salts for example ammonium chloride, sodium chloride, sodium nitrate, aluminium nitrate, potassium chloride, etc. The carriers may be used with or without a coating, which imparts the necessary triboelectric properties to the granular carrier material.

The toner material may comprise binding agent and the binding agent may be selected on the basis of its triboelectric properties. Indeed, the binding agent should allow the toner to obtain a sign of charge opposite to that of the sign of the photoconductor and of the carrier. Suitable binding agents include gum copal, gum sandarac, rosin, asphaltum, gilsonite, polystyrene and polymers of styrene homologues, copolymers of styrene and acrylates or methacrylates, colophony, esters of colophony with polyols, phenolformaldehyde resins, rosin, modified phenolformaldehyde resins, methacrylic resins, polyethylene resins, polypropylene resins, epoxy resins, and mixtures thereof. The choice of the binding agent is also determined by physical properties. The melting point should be chosen so that the properties of the toner are not altered at normal working temperatures. On the other hand the toner should be capable of being fixed by heat whereas the paper to which the toner image has been transferred should not be scorched thereby. The melting range of the toner should preferably vary therefore between 80° and 140°C. The above-mentioned binding agents can be made appropriate especially by adaptation of the molecular weight. If the melting point is too high it can be lowered by the addition to the toner of plasticizers, e.g. compounds of the ester type such as dimethyl isophthalate, dibutyl phthalate and triphenyl phosphate, low molecular weight polyethylene or polymeric plasticizers e.g. polyvinyl acetals such as polyvinyl butyral, further polynuclear aromatic compounds e.g. biphenyl, m- and p-terphenyl and polychlorinated derivatives thereof such as the azochlors, o-methoxy-benzoic acid, benzil, etc.

The toner material contains colouring matter to produce a black or other suitably coloured toner. The amount of colouring matter employed will depend on the resin used as binding agent. Thus in the case of asphaltum the amount of carbon black pigment can be as low as 1% by weight with respect to the total weight of toner mass. For colourless or nearly colourless resins such as polystyrene the amount of colouring matter may be as much as 20% by weight. Usually the colouring matter is a black pigment e.g. carbon black and bone black. In cases where a colour copy is desired organic pigments or dyestuffs can be used e.g. phthalocyanines, azo, vat and acid dyes.

For the preparation of the toner, the starting materials are best mixed in pulverised state and then ground very finely in a ball mill. The mixture is then heated to melting and the melt is very thoroughly mixed so that the colouring particles are completely incorporated in the resin. If capable of being melted, the starting materials can be melted straightaway and the other components added, with stirring. The melt is cooled and the toner substance thus obtained is ground.

For the development of the electrostatic images the toner is applied loosely to the latent electrostatic image where it is attracted electrostatically at the latent image areas. The most usual developing method is cascade development. According to this method the electrostatic toner is mixed with a granular carrier as referred to above, which may be electrically conductive or insulating.

The carrier particles, when brought in close contact with the powdery toner particles, obtain a charge of a polarity opposed to that of the toner particles, so that the latter envelop the carrier particles. If a positive reproduction of an electrostatic image is desired, the carrier is chosen in such a way that the toner particles obtain a charge with a polarity opposite to that of the electrostatic charge. In order to obtain a negative copy the carrier can be chosen in such a way that the toner particles obtain a charge having the same polarity as that of the electrostatic image.

The toner particles are attracted either by the charged or discharged areas of the surface and separated from the carrier particles, which in consequence of gravity continue their rolling motion.

The toner particles are fixed on paper or any other support by heat or solvent fixing. When heat energy is supplied or solvent is added to the toner, the toner softens, tends to become more fluid, flows together and is attached irreversibly to the paper support.

The following experiments further illustrate how the developers of the present invention are prepared and how they are utilized to develop electrostatic latent images.

EXPERIMENT 1 (comparison)

A toner was prepared from 8 parts by weight of polystyrene having a molecular weight of approximately 30,000, 1 part by weight of polyvinylbutyral comprising in addition to the vinylbutyral groups 20% by weight of vinyl alcohol units and 2.5% by weight of vinyl acetate units and 1 part by weight of Specialschwarz IV (trade name for carbon black sold by Deutsche Gold- und Silberanscheideanstalt, Frankfurt a/M, Germany).

The components were mixed in dry condition and kneaded for 30 min. at 140°C. After cooling and breaking, 60 g of the composition was ground in a vibration ball mill for 15 hours in 240 ml of water. The mixture was filtered by suction and dried to the air until a moisture content of 0.5%. By fractionation to a particle size of 2 to 30 microns a toner was obtained having a melting point of 136°C and showing weak free-flowing properties.

A developer mixture was then prepared by mixing 1 g of the toner powder with 100 g of carrier particles composed of glass beads having a diameter of 600 to 800 microns.

After positive charging of a selenium drum and imagewise exposure thereof, the developing mixture was cascaded across the surface containing the electrostatic image. The developed image was then transferred by electrostatic means to a sheet of paper whereon it was fused by heat.

The residual powder was removed from the selenium drum by means of a plug of wadding.

After the copying process just described was repeated 200 times, the copies and the selenium drum were examined as for quality and wear.

The copies possessed sharp line contrast and little background deposition. However, large solid areas were hardly developed and showed a low image density. Examination of the surface of the selenium drum with a magnifying glass revealed a number of deep scratches.

Under conditions of 80% of relative humidity and higher, images were obtained with very low contrast.

EXPERIMENT 2

To 10 g of the toner described in Experiment 1, 1 g of zinc octadecyl succinate having an average grain size of 20 microns was added and thoroughly mixed therewith. The melting point of the toner obtained was now approximately 130°C and the toner showed better free flowing properties than that of experiment 1.

From the toner formed a developer mixture was prepared as described in experiment 1 whereupon the developing procedure of experiment 1 was repeated.

As compared with experiment 1, the following results were attained:

- the images showed good contrast, higher solid area coverage and no background deposition.
- after the copying process was repeated 1000 times, the selenium drum still did not show any scratches or other damage.
- cleaning of the selenium drum by means of a plug of wadding was much easier to effect and more complete.
- in an atmosphere of even 90% of relative humidity development still occurred practically without fog.
- the number of good quality copies obtainable with a specific amount of toner was markedly higher.

EXPERIMENT 3

The same favourable results of experiment 2 were attained when in experiment 2 the zinc octadecyl succinate was replaced by zinc decyl succinate.

EXPERIMENT 4

Experiment 2 was repeated with the difference that the zinc octadecyl succinate was replaced by zinc monoisohexadecyl phosphate. Before addition to the toner particles, the zinc monoisohexadecyl phosphate was ground for 30 seconds so as to obtain very fine particles.

The copies obtained showed somewhat more fog than those of experiment 2. The other favourable properties, however, could be retained.

EXPERIMENT 5

A toner mixture was prepared from 6.8 parts by weight of polystyrene having an average molecular weight of 30,000, 1 part by weight of polyvinylbutyral comprising in addition to the vinylbutyral groups 20% by weight of vinyl alcohol units and 2.5% by weight of vinyl acetate units, 1.2 part by weight of zinc octadecyl succinate and 1 part by weight of carbon black Specialschwarz IV.

The components were mixed in dry condition and kneaded for 1 hour at 135°C. The toner mixture was then further treated as described in experiment 1 until a toner was obtained having a particle size between 2 and 30 microns. The toner possessed good free flowing properties and had a melting point of 127°C.

A developer mixture was then prepared as described in experiment 1, which was used to develop an electrostatic latent image according to the procedure of the said experiment.

The following results wee attained:

- good image contrast and solid area coverage,
- no fog on the non-image or background areas,
- high stability under conditions of high relative humidity,
- no damaging and easy cleaning of the photoconductive surface, with a same amount of toner a higher number of copies could be obtained than in experiment 1.

EXPERIMENT 6

A toner mixture was prepared from 5 parts by weight of a copolymer containing 50% by weight of styrene, 5% by weight of α-methylstyrene and 45% by weight of isobutylmethacrylate, 1 part by weight of polyvinylbutyral comprising in addition to the vinylbutyral units, 20% by weight of vinyl alcohol units and 2.5% by weight of vinyl acetate units, 1.8 part by weight of a copolymer of methylmethacrylate and n-butylmethacrylate (50:50 mole %), 1 part by weight of carbon black Specialschwarz IV, and 1.2 part by weight of zinc octadecyl succinate.

The components were mixed in dry condition and kneaded for 30 minutes at 135°C. The toner mixture was then further treated as described in experiment 1 until a toner was obtained having a particle size between 2 and 30 microns. The toner possessed good free flowing properties and had a melting point of 109°C.

A developer mixture was then prepared as described in experiment 1, which was used to develop an electrostatic latent image according to the procedure of the said experiment.

From 5,000 to 10,000 copies could be obtained which showed good image density without fog. In conditions of 80% of relative humidity and higher the quality remained excellent. Cleaning of the selenium drum was easy to effect and complete. The selenium drum did not reveal scratches and with 125 g of toner it was possible to make at least 1000 copies.

We claim:

1. A dry developing material for dry development of electrostatic images comprising a mixture of carrier particles and finely divided toner powder, said mixture having incorporated therein at least one solid hydrophobic bivalent or trivalent metal salt of a monoester or diester of a phosphorus oxyacid in a sufficient amount to improve the dry free-flowing nature thereof.

2. A material according to claim 1 wherein particles of said metal salt are loosely mixed with said toner powder and carrier particles.

3. A material according to claim 1 wherein said metal salt is present in said finely divided toner particles.

4. A material according to claim 1 wherein said metal salt is a zinc salt.

5. A material according to claim 1 wherein said metal salt comprises a hydrocarbon group containing at least 8 carbon atoms.

6. A material according to claim 1 wherein said toner powder comprises coloring matter.

7. A material according to claim 6 wherein said coloring matter is carbon black.

8. A material according to claim 1 wherein the toner powder comprises a polymer of styrene and its homologues as a binding agent.

9. A material according to claim 1 wherein said carrier particles are glass balls.

10. A material according to claim 1 whereein the carrier particles and toner powder are present in a ratio between 100 to 0.1 and 100 to 20 and the amount of said salt varies in the range of about 0.1–50% by weight of said toner.

11. A process of dry electrophotographic development comprising the steps of bringing an imaging surface carrying an imagewise pattern of electrostatic charges thereon into contact with a developing material which comprises a dry mixture of finely divided toner powder and carrier particles which has incorporated therein at least one solid hydrophobic bivalent or trivalent metal salt of a monoester or diester of a phosphorus oxyacid in a sufficient amount to improve the dry free-flowing nature thereof, at least a portion of said toner powder being attracted to said imaging surface to form a visible image of said charge pattern.

12. A process according to claim 11 which also comprises the steps of transferring said toner powder image to a receptor material, cleaning any residual toner from said imaging surface, and repeating said developing step.

13. A dry toner material for use in the dry development of electrostatic images comprising finely divided toner powder having incorporated therein at least one solid hydrophobic bivalent or trivalent metal salt of a monoester or diester of a phosphorus oxyacid in sufficient amount to improve the dry free-flowing nature of said powder.

14. A material according to claim 13 wherein said toner powder has an average size of less than 50μ and said salt is present as particles having an average size of about 1–50μ.

15. A material according to claim 13 wherein a mixture of toner material and said metal salt is fused, solidified and subdivided to form said toner powder.

16. A material according to claim 13 wherein said metal salt is present in an amount equal to about 0.5–20% by weight.

17. A material according to claim 13 wherein said metal salt is present in an amount equal to about 0.1–50% by weight.

* * * * *